US005702626A

United States Patent [19]

Kim

[11] Patent Number: 5,702,626

[45] Date of Patent: Dec. 30, 1997

[54] AUTOMATIC COOKING CONTROLLING APPARATUS AND METHOD EMPLOYING A NARROW VIEWING ANGLE OF AN INFRARED ABSORPTIVE THERMOPILE SENSOR

[75] Inventor: Tae Yoon Kim, Kyungki-do, Rep. of Korea

[73] Assignee: LG Electronics Inc., Seoul, Rep. of Korea

[21] Appl. No.: 567,847

[22] Filed: Dec. 6, 1995

[30] Foreign Application Priority Data

Dec. 14, 1994 [KR] Rep. of Korea ..... 34234/1994

[51] Int. Cl.[6] ..... H05B 6/68

[52] U.S. Cl. ..... 219/711; 219/703; 219/716; 219/510; 99/325; 374/149

[58] Field of Search ..... 219/711, 710, 219/712, 713, 703, 702, 705, 706, 716, 494, 510; 99/325, DIG. 14; 374/149

[56] References Cited

U.S. PATENT DOCUMENTS

| | | | |
|---|---|---|---|
| 4,461,941 | 7/1984 | Fukada et al. | 219/711 |
| 4,617,438 | 10/1986 | Nakata | 219/711 |
| 4,751,356 | 6/1988 | Fukada et al. | 219/711 |

FOREIGN PATENT DOCUMENTS

| | | | |
|---|---|---|---|
| 63-201430 | 8/1988 | Japan | 219/711 |
| 5-157248 | 6/1993 | Japan | 219/703 |

*Primary Examiner*—Philip H. Leung
*Attorney, Agent, or Firm*—John P. White

[57] ABSTRACT

In an automatic cooking controlling apparatus and method for a cooker, the apparatus includes a turntable installed within a chamber of the cooker for placing a to-be-cooked object thereon, an infrared filter for filtering only the infrared wavelength bands reflected from the to-be-cooked object, an infrared adjusting lens means for adjusting the wavelength filtered by the infrared filter, a magnetron for heating the to-be-cooked object, a driving motor for rotating the turntable, a thermopile sensor for detecting an infrared signal generated from the to-be-cooked object, a signal processor for processing the signal detected from the infrared sensor, and a controller for controlling the oscillation mode of the magnetron. In the controlling method, a defrost mode control is performed such that periodicity of output signals input from the sensor according to a constant period is checked to determine the size of the to-be-cooked object, the periodic signals are analyzed based on the presence of the periodicity, and then a cooking reference value suitable for the defrost mode is taken, thereby controlling the oscillation of the magnetron. A general cooking mode control is performed such that periodicity of detection signals input from the sensor according to a constant period is checked to determine the size of the to-be-cooked object, the periodic signals are analyzed based on the presence of the periodicity, and then a cooking reference value suitable for the general cooking mode is taken, thereby controlling the oscillation of the magnetron.

5 Claims, 7 Drawing Sheets

AUTOMATIC COOKING CONTROLLING APPARATUS AND METHOD EMPLOYING A NARROW VIEWING ANGLE OF AN INFRARED ABSORPTIVE THERMOPILE SENSOR

BACKGROUND OF THE INVENTION

The present invention relates to an automatic cooking controlling apparatus and method for a cooker, and more particularly, to an automatic cooking controlling apparatus and method for a cooker for performing an automatic cooking control by detecting the surface radiant temperature of an object to be cooked in a microwave cooker using an infrared absorptive sensor to form a cooking angle only with respect to the region of the to-be-cooked object.

In a conventional cooker such as a microwave oven, when the cooking is controlled automatically, the to-be-cooked object is generally cooked adopting a temperature sensor, a humidity sensor or a gas sensor to measure the temperature, humidity or gas change. The measured value is compared with a preset value programmed within a micro-processor to then further heat the to-be-cooked object for a predetermined cooking time.

However, in the aforementioned conventional cooking method, when the cooking is automatically controlled using sensors for detecting physical or chemical change such as in the temperature, humidity or gas, only the physical change of the to-be-cooked object can be indirectly measured considering reasons of the convenience and sanitation. Thus, the cooking result by the boiling time calculated in the microprocessor according to the cooking information detected from the sensor is different from the actual cooking state of the to-be-cooked object.

For example, in case of warming, the cooked object becomes hotter than a desired temperature to result in an over-cooking. Also, in case of defrosting, a desired defrosting extent is difficult to obtain to result in an under-frosting. In the automatic cooking such as warming or defrosting, the amount of the physical or chemical change should be detectable by a sensor. However, when the conventional sensor is used in the automatic cooking, the physical or chemical change is too feeble to identify an exact detection point. Thus, before the detection point is identified, since the cooking such as warming or defrosting is completed, it is difficult to control the cooking exactly due to vague detection point depending on the usage conditions such as the shape, size and material of the vessel containing the to-be-cooked object, the content of the to-be-cooked object or the position of a turntable where the to-be-cooked object is placed.

As an improved cooker for solving the above problems, an infrared sensor is mainly used as the sensor. The infrared sensor detects rapidly increasing radiant intensity depending on the increase of the surface temperature of the object cooked in the cooker by the adoption of the principle that the radiant intensity is increasing in proportion to the fourth power of the temperature of infrared emission material.

In the infrared sensor, a radiation amount detecting infrared sensor for detecting the temperature of the to-be-cooked object in the cooker is specifically effective in that the to-be-cooked object is largely composed of materials having over 70% radiation rates while metal or glass forming the cooker itself has the radiation rate of about 20% depending on its content.

However, the conventional infrared sensor has the limit in the viewing angle 19 exposed in turntable 17, as shown in FIGS. 1A and 1B, Also, the viewing angle 19 is also limited by an infrared filter 12 for filtering only infrared wavelength bands, a reflective mirror or adjusting lens 13 for adjusting the incident infrared rays, or specifications of an infrared transmitting window.

As shown in FIG. 2, the output voltage (mV) of infrared sensor 10 is inversely proportional to the square of the distance between infrared sensor 10 and infrared ray generating object (to-be-cooked object) even for the same infrared rays sources. When the cases of viewing angles 30° and 110° are compared, it is understood that the larger the viewing angle is, the more influenced by the distance.

In other words, as shown in FIG. 1, if infrared sensor 10 having sufficiently large viewing angle is adopted so that a rotating turntable 17 is wholly exposed within the viewing angle 19 (about 110° ), the output values of infrared sensor 10 may be different. Otherwise, in case of a to-be-cooked object having a small width like a coffee mug or a milk bottle, the temperature of turntable 17 exposed within the viewing angle 19 of the sensor and the surface temperature of to-be-cooked object 16 are read together, which is not an exact output value.

SUMMARY OF THE INVENTION

To solve the above problems, it is an object of the present invention to provide an automatic cooking controlling apparatus for a cooker which has a viewing angle deviated from a rotation center of a turntable and prevents an output signal of a sensor from being changed so that a to-be-cooked object is automatically cooked and the output signal from the sensor is not changed depending on the distance from the to-be-cooked object.

It is another object of the present invention to provide an automatic cooking controlling apparatus and method for a cooker for performing an automatic cooking in a defrost mode and a general cooking mode, by properly controlling a magnetron to have a precise detection value according to the position of a turntable on which a to-be-cooked object and the rotation period of the turntable to find a defrost and general cooking termination point.

To accomplish the above objects, there is provided an automatic cooking controlling apparatus for a cooker according to the present invention comprising: a turntable installed within a chamber of the cooker for placing a to-be-cooked object thereon; an infrared filter for filtering only the infrared wavelength bands detected from the to-be-cooked object during cooking the to-be-cooked object; an infrared adjusting lens means for adjusting the wavelength filtered by the infrared filter; a magnetron for emitting microwaves through a high-voltage circuit to heat the to-be-cooked object; a driving motor for rotating the turntable; an infrared sensor installed in the side of the infrared adjusting lens means for detecting an infrared signal reflected from the to-be-cooked object and forming a narrow viewing angle deviated from a rotation center of the turntable; a signal processor for processing the signal detected from the infrared sensor; and a controller for receiving the signal processed from the signal processor and controlling the oscillation mode of the magnetron.

In the automatic cooking controlling apparatus for a cooker according to the present invention, it is preferable that the infrared sensor is an infrared absorptive thermopile sensor and is installed in a predetermined region of the upper portion of the cooker with maintaining a constant angle from the infrared adjusting lens means to prevent the output voltage of the infrared sensor from being changed depending on the distance from the to-be-cooked object.

Also, there is provided an automatic cooking controlling method according to the present invention comprising the steps of: a sub-routine of checking the presence of periodicity of signals detected from an infrared sensor according to a constant period and determining the position where a to-be-cooked object is placed; a sub-routine of comparing the minimum value with a predetermined reference value for turning a magnetron off, based on the presence of signal periodicity, turning the magnetron on if it is determined that the reference value is greater than the minimum value, and repeatedly performing the sub-routine until a defrost termination point is searched, to control the oscillation of the magnetron (defrost mode controlling step); a sub-routine of checking the presence of periodicity of signals detected from an infrared sensor and determining the position where a to-be-cooked object is placed; and sub-routine of comparing the maximum value with a predetermined reference value for turning a magnetron off, based on the presence of signal periodicity, turning the magnetron on if it is determined that the reference value is greater than the maximum value, and repeatedly performing the sub-routine until a general cooking termination point is searched, to control the oscillation of the magnetron (general cooking mode controlling step).

BRIEF DESCRIPTION OF THE DRAWINGS

The above objects and advantages of the present invention will become more apparent by describing in detail a preferred embodiment thereof with reference to the attached drawings in which:

FIGS. 1A and 1B illustrate viewing angles of a conventional infrared sensor for a cooker, in which FIG. 1A is a vertical sectional view for explaining the internal structure of the cooker, and FIG. 1B is a plan view of a virtual viewing angle formed a turntable for the cooker;

FIGS. 3A and 3B illustrate viewing angles of an infrared sensor for a cooker according to the present invention, in which FIG. 3A is a vertical sectional view for explaining the internal structure of the cooker, and FIG. 3B is a plan view of a virtual viewing angle formed a turntable for the cooker;

DETAILED DESCRIPTION OF THE INVENTION

Figure 1A:
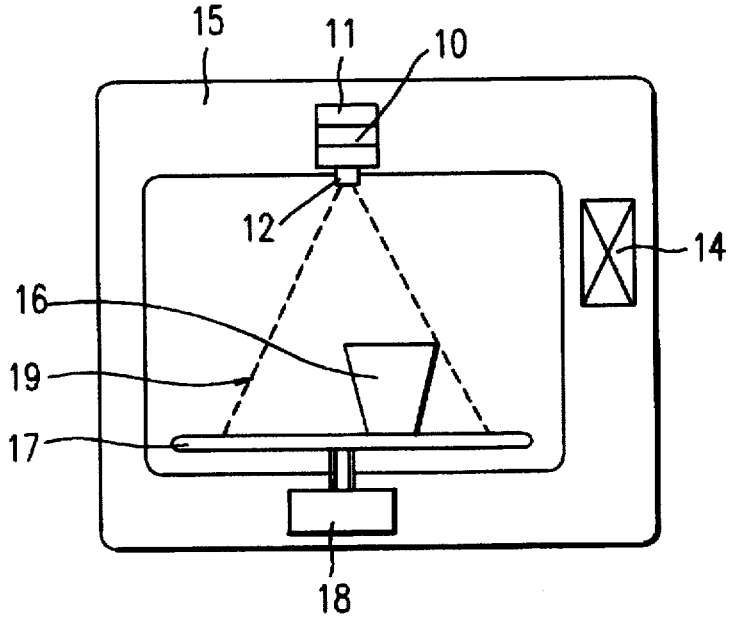
F I G.1A prior art
Figure 1B:
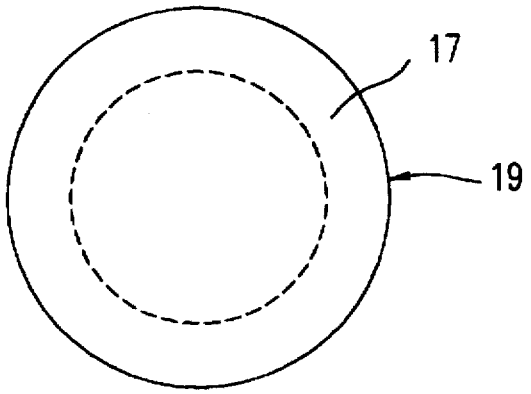
F I G.1B prior art
Figure 2:
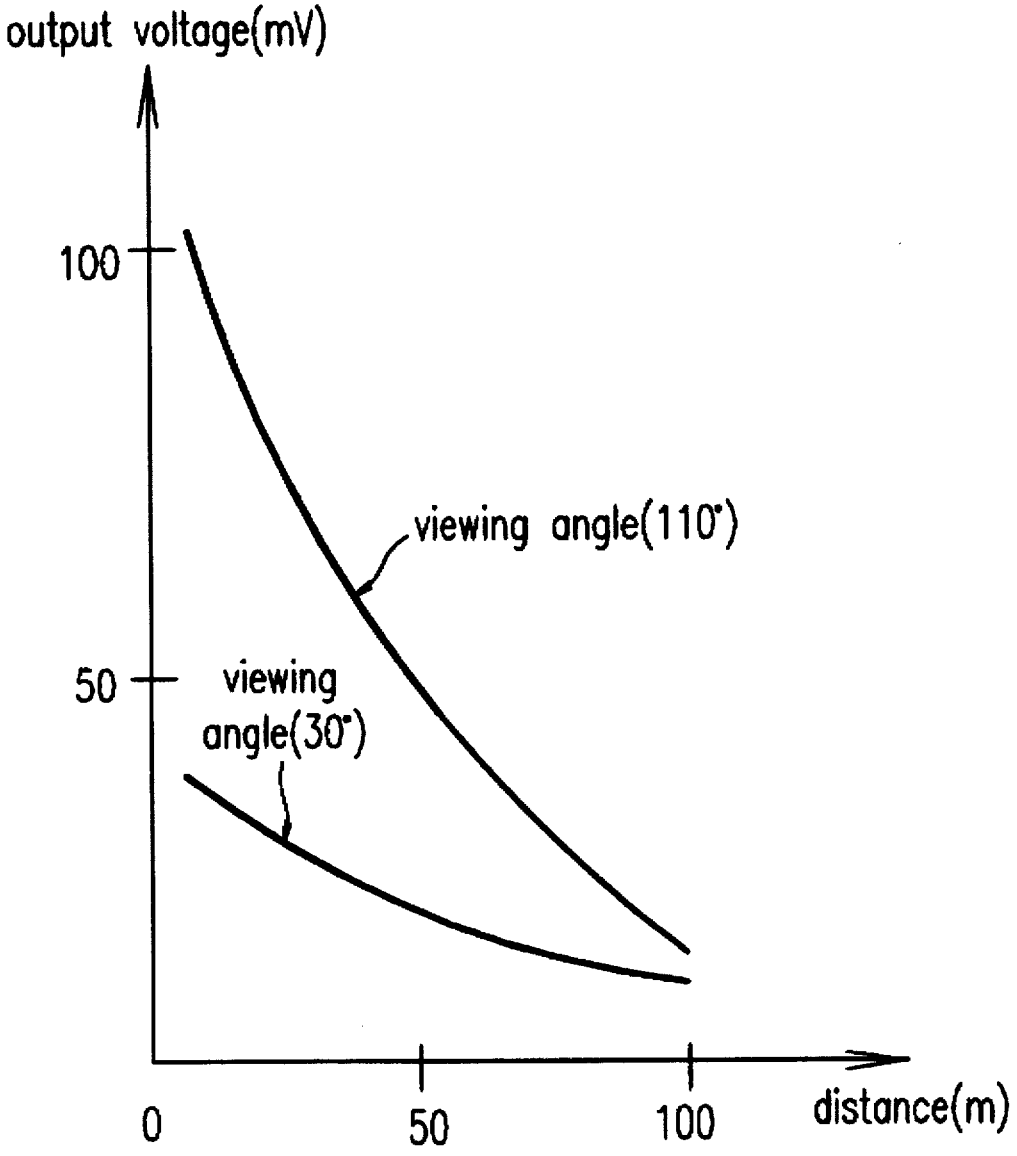
F I G.2 prior art
FIG. 2 is a graph showing the viewing angle depending on the cooking distance versus the output voltage in a general infrared sensor.
Figure 3A:
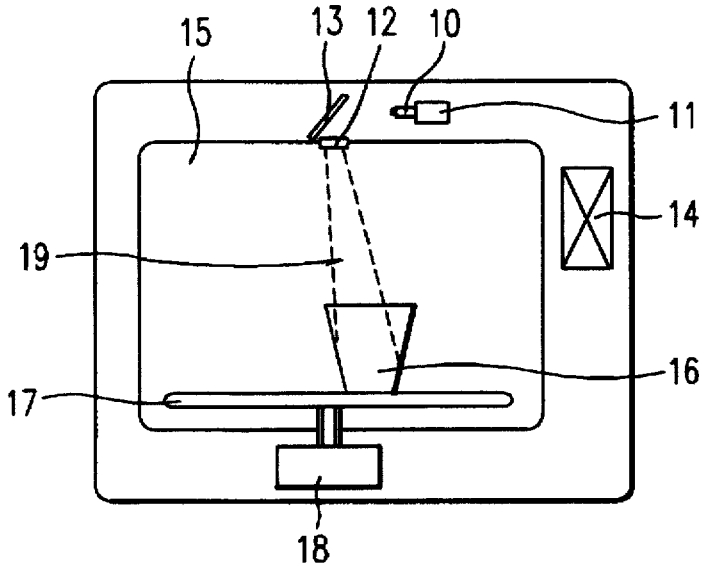
F I G.3A prior art
Figure 3B:
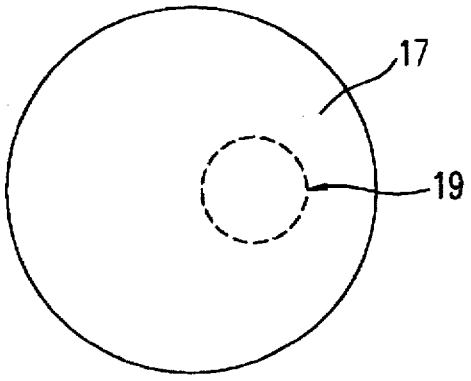
F I G.3B prior art

FIG. 3A is a vertical sectional view showing a cooker incorporating an infrared sensor 10 having too a narrow viewing angle to be influenced by the output voltage of the sensor 10 even for the change of the cooking distance from a to-be-cooked object, e.g., a thermopile sensor. FIG. 3B is a plan view of a virtual viewing angle formed a turntable 17 for the cooker shown in FIG. 3A.

Referring to FIG. 3A, the automatic cooking controlling apparatus for the cooker according to the present invention includes an infrared filter 12 for filtering only the infrared wavelength bands emitted from a to-be-cooked object 16 within a chamber 15 and preventing an infrared sensor 10 from being contaminated by steam, a turntable 17 installed within chamber 15 for placing the to-be-cooked object 16 thereon, an infrared reflective mirror or adjusting lens means 13 for adjusting the amount and direction of infrared rays filtered and input from infrared filter 12, a magnetron 14 for generating high-frequency signals to heat to-be-cooked object 16, a driving motor 18 for rotating turntable 17, an infrared sensor 10 installed in the side of infrared adjusting lens means 13 for detecting infrared rays generated from to-be-cooked object 16 and forming a narrow viewing angle deviated from a rotation center of turntable 17 in order to prevent the output signal from being changed depending on the distance from to-be-cooked object 16, a detection signal processor 11 for processing the output signal of infrared sensor 10, and a micro-processor 20 for taking in advance an arbitrary cooking reference signal from the processed periodic signals during defrost mode and general cooking mode and controlling the oscillation mode of magnetron 14.

Also, as infrared sensor 10, an infrared absorptive thermopile sensor may be adopted. The infrared absorptive thermopile sensor is installed in a predetermined region of the upper portion of cooker with maintaining a constant angle from infrared reflective mirror or adjusting lens means 13 to prevent the output voltage of sensor from being changed depending on the distance from to-be-cooked object 16.

Figure 4:
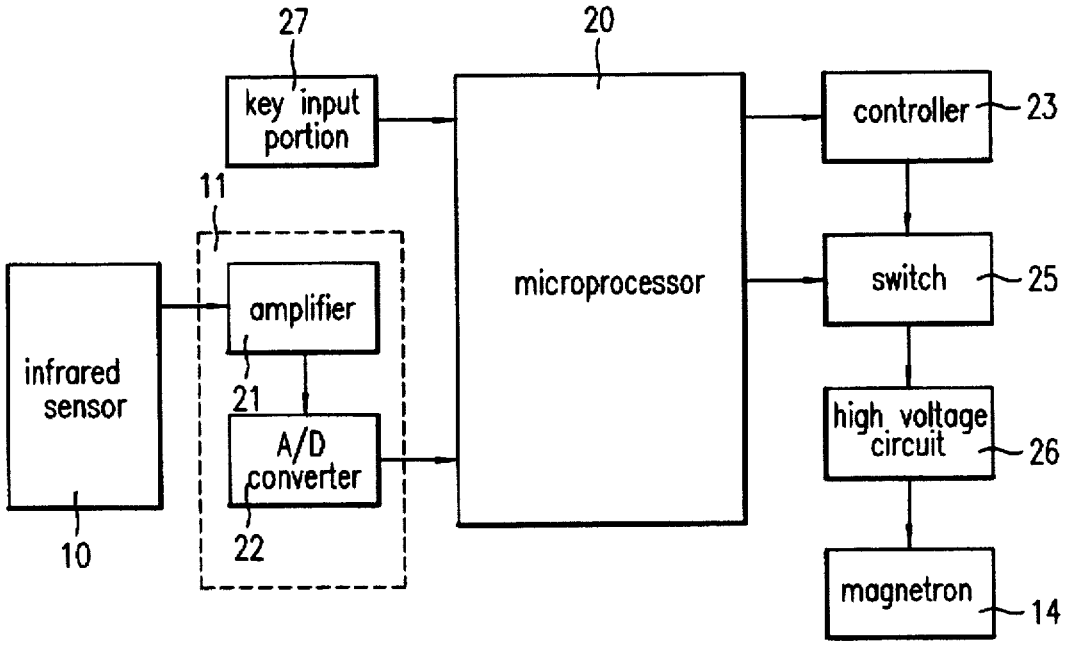
FIG. 4 is a schematic block diagram of an automatic cooking controlling apparatus for a cooker according to the present invention.

FIG. 4 is a schematic block diagram of an automatic cooking controlling apparatus for a cooker according to the present invention.

As shown in FIG. 4, detection signal processor 11 includes an amplifier 21 for amplifying the signal supplied from infrared sensor (here, thermopile sensor) 10 and compensating form the temperature and an analog/digital (A/D) converter 22 for converting the output signal of amplifier 21 into digital signal.

Micro-processor 20 includes a controller 23 for controlling the digitally converted signal for each mode according to the cooking method and a key input portion 27 for selecting a food menu and a cooking method.

Magnetron 14 includes a switch 25 for receiving operative voltage from high-voltage circuit 26 and turning magnetron 14 on and off and several peripheral circuits.

A user selects and inputs the food menu and cooking method through key input portion 27 after placing to-be-cooked object 16 on turntable 17 of chamber 15. At this time, infrared sensor 10 and infrared adjusting lens means 13 function to form a predetermined viewing angle for to-be-cooked object 16.

Subsequently, if a cooking start button of key input portion 27 is pressed, microwaves are emitted by high-voltage circuit 26 and magnetron 14, so that to-be-cooked object starts to be cooked. Then, the difference between temperature of the portion within the viewing angle and that of the portion beyond the viewing angle is detected by infrared sensor 10 to then be input to amplifier 21 and A/D converter 22.

Then, when the detection signal processed by A/D converter 22 is applied to micro-processor 20 by A/D converter 22, micro-processor 20 outputs a data signal to controller 23 according to a cooking mode. Subsequently, a control signal of controller 23 and a switching signals output from microprocessor 20 are supplied to switch 25, and high-voltage circuit 26 and magnetron 14 are controlled to be turned off, thereby cooking to-be-cooked object 16.

Figure 5:
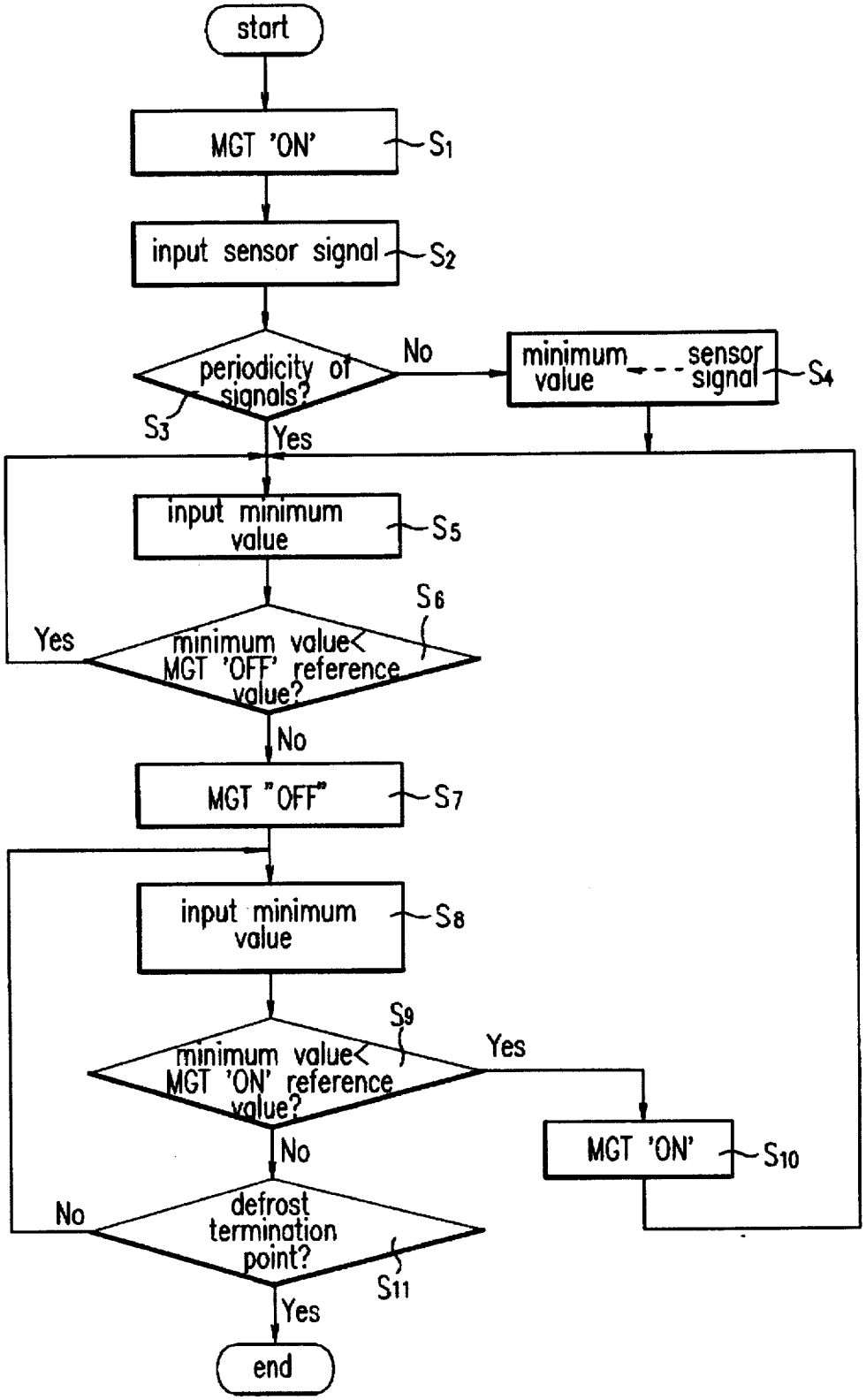
FIG. 5 is a flowchart showing the controlling sequence during cooking in a defrost mode of the automatic cooking controlling method according to the present invention.
Figure 6:
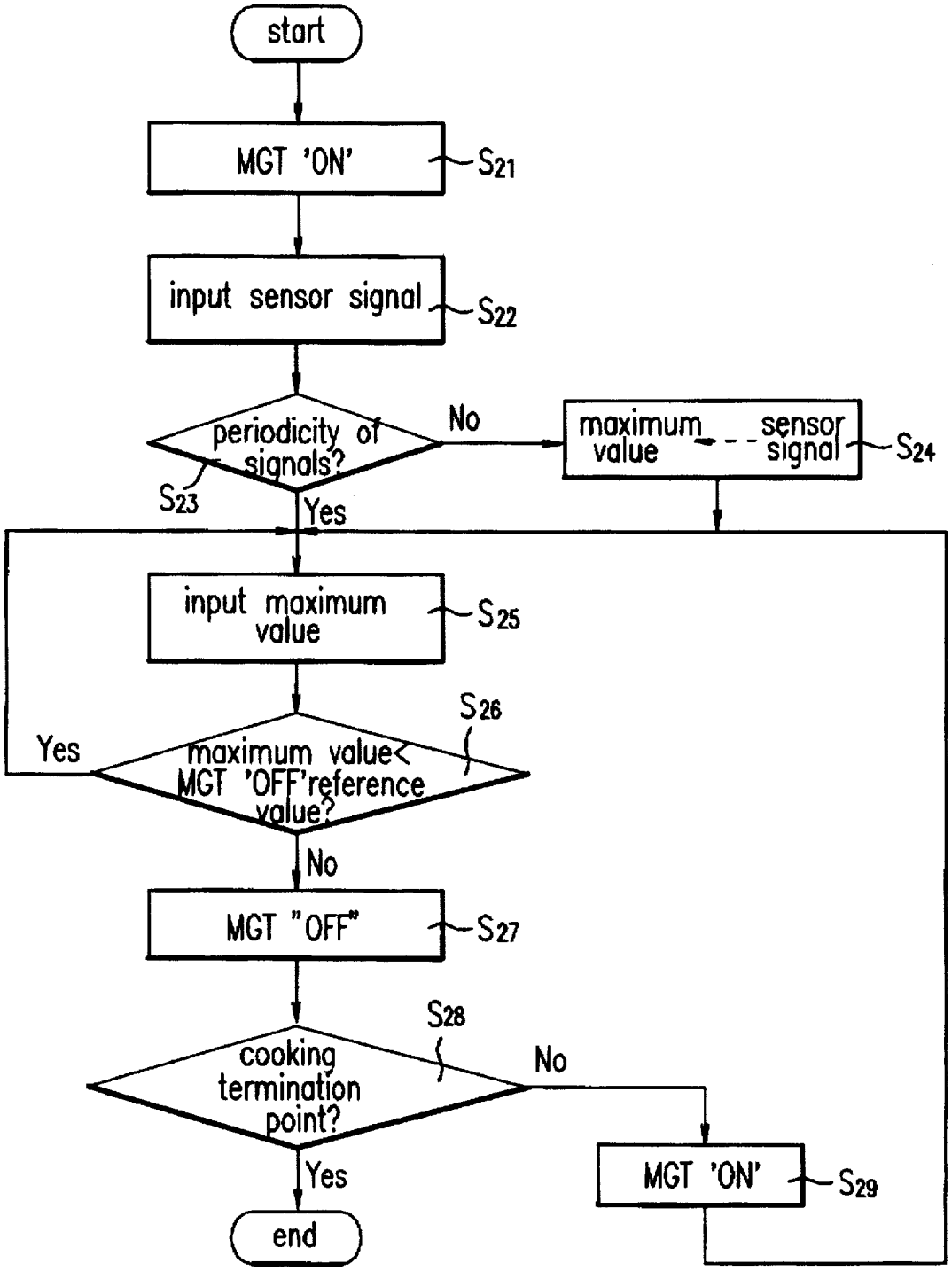
FIG. 6 is a flowchart showing the controlling sequence during cooking in a general cooking mode of the automatic cooking controlling method according to the present invention.

The automatic cooking control for the cooker is divided into a defrost cooking mode shown in FIG. 5 and a general cooking mode shown in FIG. 6.

FIG. 5 is a flowchart showing the controlling sequence during cooking in the defrost mode of the automatic cooking controlling method according to the present invention, which includes a first sub-routine (S1 through S3) of checking the periodicity of the detection signal input from an infrared sensor to determine the size of a to-be-cooked object, a second sub-routine (S4 and S5) of taking the minimum value of period signals as a cooking reference value of the defrost mode, based on the presence of the periodicity in first subroutine, and a third sub-routine (S6 through S11) of comparing a reference value for turning the magnetron off and a reference value for oscillating the magnetron, which is predetermined and stored for the defrost mode, using the minimum value taken in second sub-routine, to control the oscillation of the magnetron.

FIG. 6 is a flowchart showing the controlling sequence during cooking in a general cooking mode of the automatic cooking controlling method according to the present invention, which includes a fourth sub-routine (S21 through S23) of checking the periodicity of the detection signal input from the infrared sensor to determine the size of a to-be-cooked object, a fifth sub-routine (S24 and S25) of taking the maximum value of period signals as a cooking reference value of the general cooking mode, based on the presence of the periodicity in fourth sub-routine, a sixth sub-routine (S26 through S29) of comparing a reference value for turning the magnetron off and a reference value for oscillating the magnetron, which is necessary for the general cooking mode, using the maximum value taken in fifth sub-routine, to control the oscillation of the magnetron.

The operation of the automatic cooking controlling apparatus and method for the cooker according to the present invention having the aforementioned configuration will now be described.

In the operation shown in FIG. 4, if keys concerning on the cooking method and food menu selected in key input portion 27 are input, a door-closing state is detected in controller 23. If the door is closed, magnetron 14 is oscillated to drive driving motor 18, thereby rotating turntable 17.

A value corresponding to the surface temperature of to-be-cooked object 16 is supplied from infrared sensor 10 in a constant period and the amplified and digitally converted information is input to micro-processor 20, thereby controlling the oscillation mode of magnetron 14 using a programmed algorithm to perform an automatic cooking of an oven.

In order to control the automatic cooking, a sensor for detecting the cooking state of a to-be-cooked object exactly is essential. Therefore, in the present invention, a thermopile sensor is used for performing the automatic cooking control operation. If the to-be-cooked object is exceedingly larger than the range of the viewing angle of the thermopile sensor, in spite of a narrow viewing angle and the rotation of a turntable, a stable signal is output and the influence of the cooking distance due to the narrow viewing angle becomes ineffective, thereby implementing a control algorithm simply.

However, when the to-be-cooked object is small or is not exactly placed in the center of the turntable, the output signal of the thermopile sensor has the maximum value and minimum value according to the rotation period of the turntable.

Figure 7:
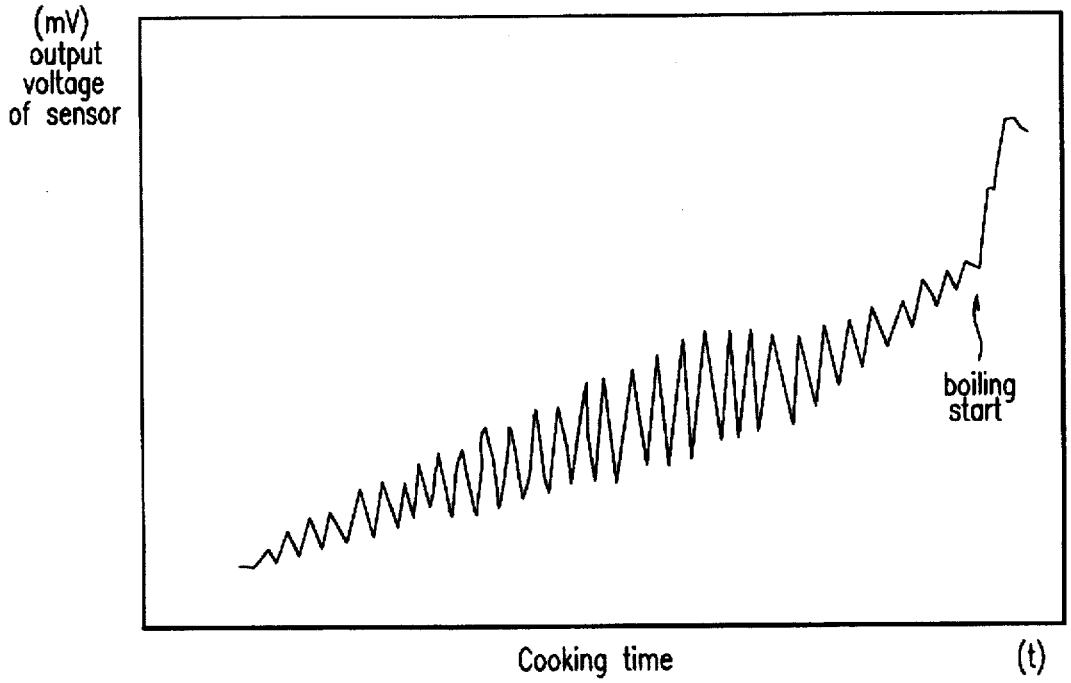
FIG. 7 is an output characteristic diagram of the infrared sensor adopted for the cooker according to the present invention.

In other words, in performing a general cooking other than the defrost mode, as shown in FIG. 7, the maximum value is the value when the to-be-cooked object is within the viewing angle of the sensor, i.e., closest thereto. The minimum value is the value when the to-be-cooked object is farthest to the sensor.

As the defrosting is proceeded, the difference between the maximum value and the minimum value becomes smaller, and becomes the same as the case of the general cooking after a point of time. This time of point is when the defrosting process is completed and the to-be-cooked object starts to be cooked. therefore, in case of the defrosting, a defrosting termination point is set before the inversion occurs.

The operation of the automatic cooking controlling apparatus for the cooker according to the present invention will now be described with reference to FIGS. 5 and 6.

First, as shown in FIG. 5, if a user inputs a cooking selection key from menu keys of the cooker, it is detected whether a defrost key or another cooking key is input, and the cooking starts in the defrost mode or another mode such as warming mode.

Micro-processor 20 checks the door closing state prior to the oscillation of magnetron 14 and drives turntable 20 and a fan (not shown) for a constant time to initialize the condition of chamber 15.

Then, magnetron 14 is driven (step S1), and the temperature of to-be-cooked object 16 is increased accordingly, which is detected by infrared sensor 10 and the signal values corresponding to the radiant temperature of to- be-cooked object 16 is input to micro-processor 20 (step S2).

Subsequently, for an initially set time, micro-processor 20 determine whether the signal values are increased or decreased periodically according to the rotation period of turntable 17 (step S3). If there is a periodicity of the signals, the minimum value (or the maximum value) maintaining the same period until the cooking is completed and then a cooking reference value (the minimum value during the defrost mode shown in FIG. 5, or the maximum value during the general cooking mode shown in FIG. 6) is set (step S5).

Even if turntable 17 operates but there is no periodicity, since the output signal is stable by the larger to-be-cooked object 16 than the viewing angle 19 of infrared sensor 10, the signal itself is set as the cooking reference value (step S4), thereby controlling the cooking in the determined controlling method until the cooking termination point.

If it is determined that there is periodicity to take the maximum value and the minimum value in a constant period, in case of the defrost mode shown in FIG. 5, the minimum value is compared with a predetermined reference value for turning magnetron 14 off (step S6). If the sensor output value exceeds the reference point, magnetron 14 stops operating (step S7).

At this time, the surface temperature of to-be-cooked object 16 is decreased again by the difference from the internal temperature thereof and the internal heat exchange of to-be-cooked object 16, which results in the reduction of the sensor output value. Therefore, the minimum value of the output signals of infrared sensor 10 is received (step S8) and is monitored continuously to compare the same with a reference value for turning magnetron 14 on again (step S9).

If the sensor output value is decreased to below the reference value for turning magnetron 14 on again, magnetron 14 operates again (step S10). These processes are repeatedly performed until the cooking termination point (step S11).

The output of magnetron in the respective magnetron oscillating periods which is the optimum output experimentally obtained is oscillated in the respective periods.

If the signal value of infrared sensor 10 is not lesser than a predetermined value (a defrost termination point) depending on the cooking purpose in a constant count, i.e., in a constant time, any longer, which is a cooking termination point, the cooking is completed (step S11).

The automatic cooking controlling method during cooking in the general cooking mode such as warming according to the present invention shown in FIG. 6 is the same as that shown in FIG. 6. However, in this case, the cooking reference value compared with the reference value for turning magnetron 14 on and and the reference value for turning magnetron 14 on again is obtained by taking the maximum value of infrared sensor 10.

As described above, according to the present invention, since the cooking state of the to-be-cooked object is exactly detected, the optimum cooking such as defrost or warming can be proceeded and the versatile cooking function and food menu are allowed.

What is claimed is:

1. An automatic cooking controlling apparatus for a cooker comprising:

a turntable installed within a chamber of said cooker for placing a to-be-cooked object thereon;

an infrared filter for filtering only the infrared wavelength bands detected from said to-be-cooked object during cooking of said to-be-cooked object;

an infrared adjusting means for adjusting a path of the wavelength filtered by said infrared filter;

a magnetron for emitting microwaves through a high-voltage circuit to heat said to-be-cooked object;

a driving motor for rotating said turntable;

an infrared absorptive thermopile sensor installed in the side of said infrared adjusting means for detecting an infrared signal reflected from said to-be-cooked object and forming a narrow viewing angle deviated from a rotation center of said turntable;

a microprocessor for processing the signal detected from said infrared sensor; and a controller for receiving the signal processed from said microprocessor and controlling the oscillation mode of said magnetron.

2. An automatic cooking controlling apparatus for a cooker as claimed in claim 1, wherein said infrared absorptive thermopile sensor is installed in a predetermined region of the upper portion of said cooker and set at a constant angle from said infrared adjusting lens means to prevent the output voltage of said infrared sensor from being changed depending on the distance from said to-be-cooked object.

3. An automatic cooking controlling method for a cooker using a microprocessor comprising the steps of:

checking the position where a to-be-cooked object is placed on a turntable in the cooker thereby checking for the presence of periodicity of signals detected from an infrared absorptive thermopile sensor depending on the turntable rotating period;

controlling a specified defrost mode or general cooking mode, even if the signal detected from the infrared absorptive thermopile sensor is periodic;

cooking in the determined controlling mode until a cooking termination point according to the signal itself is set as a cooking reference value, even if the signals detected from infrared absorptive thermopile sensor is not periodic.

4. An automatic cooking controlling method for a cooker as claimed in claim 3, wherein said defrost mode controlling step includes comparing the minimum value with a predetermined reference value for turning a magnetron off, based on the presence of said periodicity, turning said magnetron on if it is determined that said reference value is greater than the minimum value, and repeatedly checking until a defrost termination point is searched, to control the oscillation of said magnetron.

5. An automatic cooking controlling method for a cooker as claimed in claim 3, wherein said general cooking mode controlling step includes comparing the maximum value with a predetermined reference value for turning a magnetron off, based on the presence of said periodicity, turning the magnetron off if it is determined that the reference value is greater than said maximum value, and repeatedly checking until a general cooking termination point is searched, to control the oscillation of said magnetron.

* * * * *